US010245472B1

(12) United States Patent
Worsham

(10) Patent No.: US 10,245,472 B1
(45) Date of Patent: Apr. 2, 2019

(54) AUTOMATIC ANTI-BRIDGING DEVICE FOR USE WITH A BALL WASHER

(71) Applicant: Jack W. Worsham, Greensboro, NC (US)

(72) Inventor: Jack W. Worsham, Greensboro, NC (US)

( * ) Notice: Subject to any disclaimer, the term of this patent is extended or adjusted under 35 U.S.C. 154(b) by 0 days.

(21) Appl. No.: 15/955,940

(22) Filed: Apr. 18, 2018

(51) Int. Cl.
*A47L 5/38* (2006.01)
*A63B 47/04* (2006.01)
*A63B 47/02* (2006.01)

(52) U.S. Cl.
CPC ..... *A63B 47/04* (2013.01); *A63B 47/025* (2013.01); *A47L 5/38* (2013.01); *A63B 2047/028* (2013.01); *A63B 2047/046* (2013.01)

(58) Field of Classification Search
CPC ..... A63B 2047/028; A63B 2047/025; A63B 2047/046; A63B 47/02; A63B 47/04; A47L 5/38
USPC ..... 15/3.13, 3.19, 3.16, 303, 306.1, 308
See application file for complete search history.

(56) References Cited

U.S. PATENT DOCUMENTS 4,181,996 A * 1/1980 Hollrock ..... A63B 47/04 15/21.2
5,454,877 A 10/1995 Worsham
5,647,089 A 7/1997 Hollrock
5,669,096 A * 9/1997 Worsham ..... A63B 47/04 15/21.2
5,673,918 A 10/1997 Bigari
6,389,639 B1 5/2002 Worsham

* cited by examiner

*Primary Examiner* — David Redding
(74) *Attorney, Agent, or Firm* — Tuggle Duggins P.A.; Blake Hurt

(57) ABSTRACT

An agitator for use in agitating lightweight polymeric balls in conjunction with a ball washing device is disclosed and includes a base portion, a standing portion attached to the base portion, with the station portion oriented in a vertical direction and generally perpendicular to a horizontal plane formed by the base portion; a motor having a rotatable shaft, a linkage connected to the rotatable shaft, and a bumper connected to the linkage at a location different from the rotatable shaft; and a tubular member connected to the standing portion, the tubular member having an internal diameter that is generally free of obstructions, to facilitate passage of balls through said tubular member when the balls are subjected to a negative pressure differential within the tubular member for transport to a ball washer device.

20 Claims, 12 Drawing Sheets

AUTOMATIC ANTI-BRIDGING DEVICE FOR USE WITH A BALL WASHER

FIELD OF THE INVENTION

The invention herein pertains to an agitator apparatus and method for uptake of play balls and particularly pertains to an agitator apparatus for use in combination with a ball washer device used to wash polymeric balls used in ball pools and pens for children.

DESCRIPTION OF THE PRIOR ART AND OBJECTIVES OF THE INVENTION

Ball pens and ball pools are confined areas filled with thousands of lightweight polymeric balls that are popular play attractions at amusement parks, family camping facilities, commercial restaurants, playgrounds, and similar entertainment venues. In order to maintain the balls and pens in a clean and safe condition, regular cleaning of the balls and the confined area in which the children play has become a routine maintenance task. Use of ball washing machines, such as that set forth in U.S. Pat. No. 6,389,639 in performance of this maintenance procedure is common.

An important step in the ball cleaning procedure is the delivery of the balls from the pen or pool to the ball washer. In prior art processes, the step of delivering the balls was generally rather labor intensive or complicated. U.S. Pat. No. 5,454,877, for example, teaches that the balls are manually removed from the pen and transported to a hopper, which feeds the balls into the machine. U.S. Pat. No. 5,647,089 teaches the use of a tube, operating under negative air pressure. While it is possible to simply place the tube into the collection of balls, once the balls in the immediate area are gone, the tube must be moved to a new location. Thus, for optimal efficiency, an operator is required to physically operate the tube to manually vacuum the balls. U.S. Pat. No. 5,673,918 teaches locating a ball intake tube within a designated "target" area in the confined play space. Children are encouraged to place balls within the ball intake area by setting up specific "targets," such as a hoop or bullseye, which would induce the children to toss balls into the ball intake area. When balls enter the opening in the hoop or bullseye, they contact a conveyor, which delivers the balls to the washer.

Thus, in view of the problems and disadvantages associated with prior art devices, the present invention was conceived and one of its objectives is to provide a ball agitator that can be used in conjunction with a negative pressure device to facilitate removing the balls from the confined play area and delivering them to the ball washer.

It is another object of the present invention to provide a ball agitator that is simple to construct and operate.

It is another objective of the present invention to provide a ball agitator that can be used directly in a confined play area containing the polymeric balls.

It is still another objective of the present invention to provide a ball agitator that requires minimal human interaction or labor to operate.

It is yet another objective of the present invention to provide a method of facilitating the transport of lightweight polymeric balls from a ball pool to a ball washer.

Various other objectives and advantages of the present invention will become apparent to those skilled in the art as a more detailed description is set forth below.

SUMMARY OF THE INVENTION

The aforesaid and other objectives are realized by providing an agitation apparatus for use in combination with a negative pressure differential device for delivery of lightweight polymeric balls to a ball washer and method of delivering lightweight polymeric balls to a ball washer using an agitation apparatus and negative pressure differential device. The agitator apparatus includes a base portion and a standing portion disposed at generally a right angle to the base portion. The standing portion includes a tube having an internal diameter sized to receive the polymeric balls within the tube. Positioned within the base portion is a motor assembly having a rotating armature with an attached bumper. In operation, the bumper on the rotating armature contacts the polymeric balls and agitates the balls, thus directing the balls to a position underneath a tube. A negative pressure differential within the tube, such as a vacuum as might be supplied by a ball washer device, draws the balls into the tube where they are subsequently transported to a ball washer device.

DETAILED DESCRIPTION OF THE PREFERRED EMBODIMENT AND OPERATION OF THE INVENTION

Figure 1:
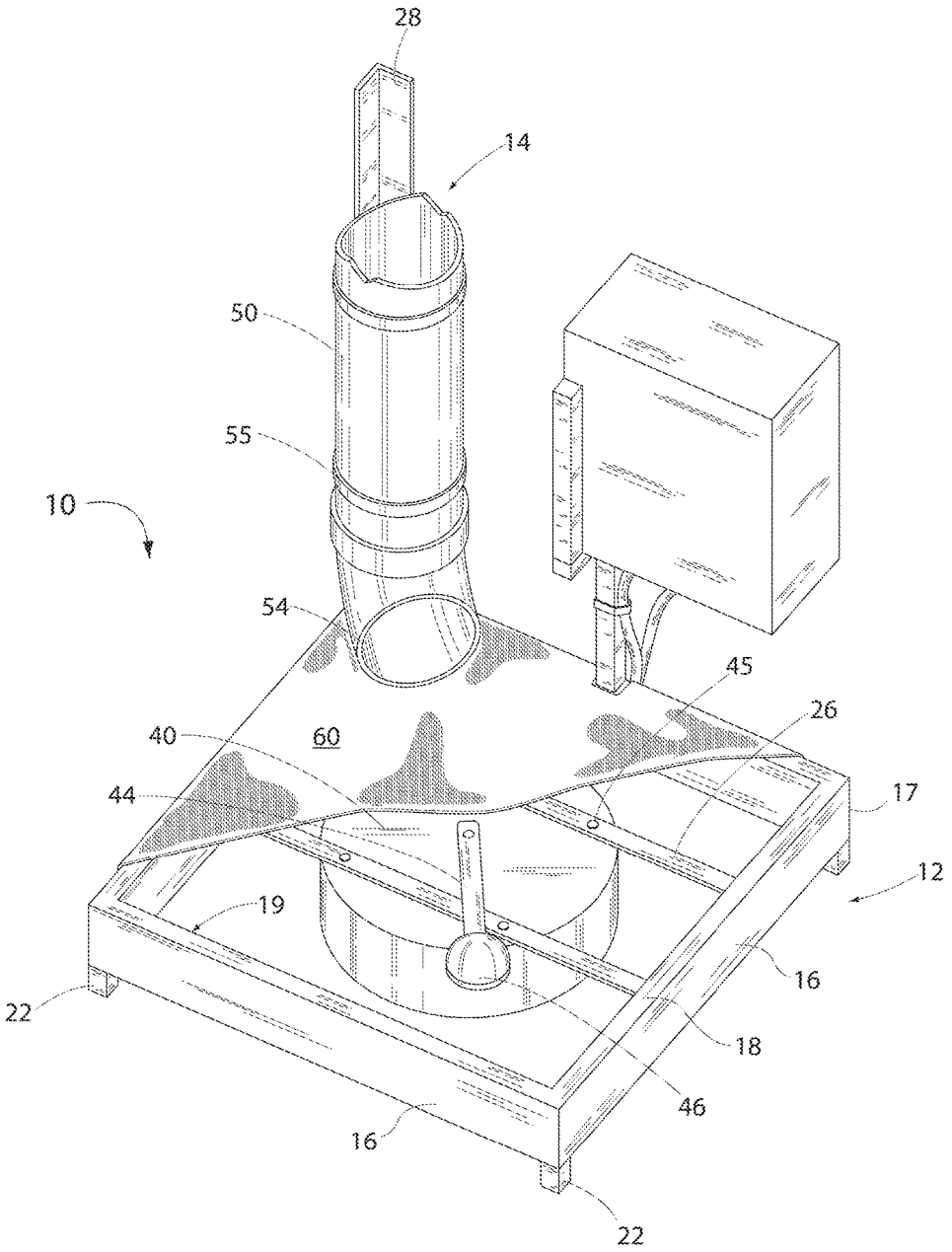
FIG. 1 shows a partially sectioned, perspective view of an agitator apparatus.

For a better understanding of the invention and its operation, turning now to the drawings, FIG. 1 is a perspective view of an embodiment of the agitator apparatus 10. The agitator apparatus 10 has a base portion 12 and a standing portion 14. Base portion 12, as seen in the Figures, is a polygonal structure having a box-like configuration. While a preferred polygonal shape is a square or rectangle, other shapes such as triangle, trapezoid, parallelogram, circles, ovals, etc. may also be used to advantage. The base portion 12 has a frame member 18 defined by one or more sidewalls 16. The sidewalls 16 are arranged into the desired polygonal shape and connected together at their respective longitudinal ends in any known manner, foaming the corners 17 of the polygon. The sidewalls 16 also form the vertical outer surface of the base portion 12. The frame member 18 is connected to the sidewalls in any known manner and is disposed at a general right angle to the sidewalls 16. The plane defined by the frame member 18 forms the top section 20 of the base portion 12. Frame member 18 may be formed integral with the sidewalls 16 or it may be a separate piece attached to the sidewalls 16. The respective widths of sidewalls 16 and frame member 18 may vary, but an embodiment of base portion 12 includes frame member 18 that extends inwardly beyond the width of sidewalls 16, creating a small lip or flange therein.

Base portion 12 includes legs 22 that are conveniently disposed at the corners 17 of the polygon. Legs 22 extend beyond the lower edge 24 of the sidewalls 16 and provide a space between the lower edge 24 of sidewalls 16 and motor 40 and a surface or substrate (not shown) on which the agitator apparatus 10 is placed. As explained below, cross braces 26 traverse the open top section 20 of the base section 12 and may provide a convenient location for mounting the motor 40 and when attached to the sidewalls 16 or frame member 18, or both, provide additional rigidity and stability to the base portion 12 (for example to prevent oscillation and/or inadvertent and undesirable displacement of base portion 12 during use).

Figure 6:
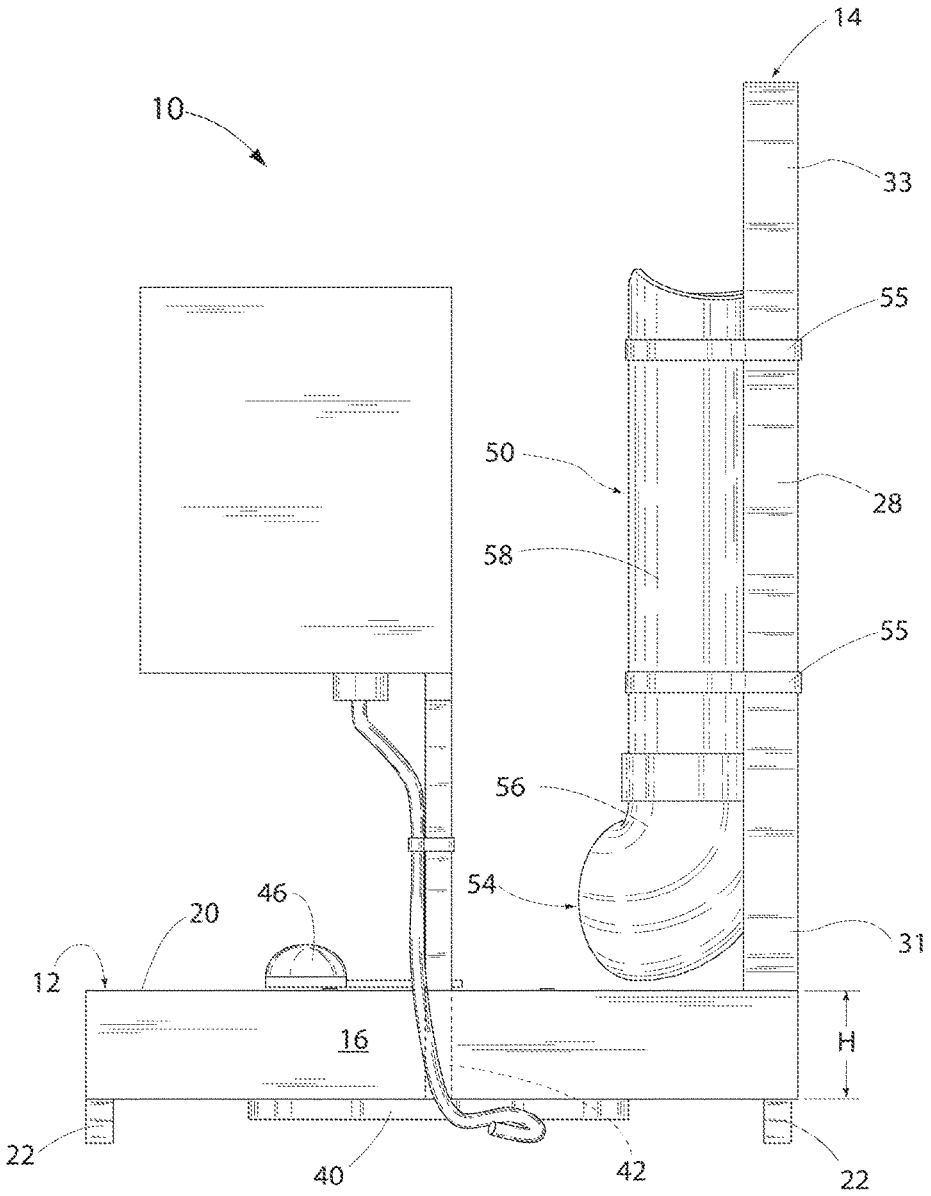
FIG. 6 is a rear view of the agitator apparatus of FIG. 1.

The component pieces forming the base portion 12, namely the sidewalls 16, frame member 18, legs 22 and cross braces 26 may be constructed out of any suitable material, including wood, plastic, metal, fiberglass, or composites. One embodiment is formed with frame member 18 formed from one inch (2.54 cm) square tubing and sidewalls 16 formed from three-quarter inch (1.91 cm) angle iron. Similarly, the method of attaching these component pieces to one another may be of any known method, including the use of adhesives, welding, or use of mechanical fasteners like nails, screws, bolts, rivets, etc. Those skilled in the art will also recognize the possibility that the base portion 12 may comprise a single unitary structure formed by molding, casting, machining, pressing, three-dimensional printing, or other known techniques, if desired. In order to minimize damage to the play balls, portions of the base member that may present a sharp edge, such as the corner 17, may be rounded. While the dimensions of the base portion are not particularly significant, in one embodiment the base portion has width W (FIG. 3) of approximately twelve inches (30.48 cm), a length L (FIG. 3) approximately twelve inches (30.48 cm), and a height H (FIG. 6) of approximately three and a quarter inches (8.25 cm).

In the embodiment of FIGS. 1-6, the standing portion 14 of the agitator apparatus 10 comprises a vertical member 28 disposed at one of the corners 17 of the base portion 12. Vertical member 28 has a first end 31 and a second end 33. The first end 31 is attached to the base portion 12, and preferably to the frame member 18 of base portion 12. The vertical member 28 is disposed generally perpendicular to the plane defined by the top section 20 of base portion 12.

The vertical member 28 may be constructed out of any suitable material, including wood, plastic, metal, fiberglass, or composites and may be attached to the base portion 12 may be of any known method, including the use of adhesives, welding, or use of mechanical fasteners like nails, screws, bolts, rivets, etc. Those skilled in the art will also recognize the possibility that the standing portion 14 may comprise a single unitary structure formed by molding, casting, machining, three-dimensional printing, or other known techniques, if desired. To minimize damage to the play balls, any portions of the standing portion 14 that might present a sharp edge may be rounded. While the dimensions of the standing portion are not particularly significant, in one embodiment the standing portion is formed by three quarter inch (1.91 cm) angle iron and has a length of approximately twenty inches (50.8 cm).

The agitator apparatus 10 further includes a motor 40, which may advantageously be an electric motor operating on either AC or DC current. Motor 40 includes a vertical shaft 42 which rotates when the motor is in operation. An armature 44 is connected to shaft 42 so as to rotate with the shaft 42 when the motor 40 is in operation. A bumper 46 is attached to the armature 44 at an end of the armature 44 distal or remote from the connection between the armature 44 and the shaft 42. Accordingly, it is understood that the bumper 46 and armature 44 both rotate with the shaft 42 during operation of motor 40. It is advantageous that the shaft 42 be fixed relative to the center of motor 40 such that the movement of bumper 46 is generally concentric as opposed to eccentric. It is also advantageous that during operation, the shaft 42, armature 44 and bumper 46 rotate in a clockwise direction, as indicated by arrow 48 in FIG. 3.

While not particularly significant, the length of the armature will be selected such that the armature may freely rotate without striking any portion of the agitator assembly 10, such as base portion 12 or standing portion 14, but defines a sufficient length such that armature 44 passes proximal to intake edge 54 of tubular member 50. In some embodiments, the length of the armature may be approximately three and an eighth inches (7.93 cm) and formed from one half inch (1.27 cm) square or cylindrical tubing. Preferred bumper 46 is a domed member formed from nylon with a diameter of approximately one and a quarter inches (3.16 cm).

In order to prevent movement of motor 40 during operation, the motor 40 should be secured in place relative to the base portion 12. In a preferred embodiment, the motor 40 is secured to the cross members 26 by a plurality of fasteners 45 (see FIG. 3). Fasteners 45 may, for example, be bolts, screws, rivets or other mechanical fasteners, strapping, adhesives, welds or other fastening device. The bumper 46 preferably has a rounded outer surface to minimize any damage to the play balls. Similarly, the bumper 46 constructed out of any suitable material, including wood, plastic, metal, fiberglass, or composites.

The agitator apparatus 10 further includes a tubular member 50, which in the Figures is represented as a transparent tube. The tubular member 50 may conveniently be made of plastic such as acrylic, polyethylene, polycarbonate, polyvinyl chloride ("PVC"), acrylobutadiene styrene ("ABS") or other known rigid materials. Tubular member 50 has an internal diameter that will permit the passage of polymeric balls therethrough without hindrance. During operation, as will be explained more fully below, the polymeric balls are drawn into the tube in the direction of arrow 52 (see FIG. 2) by the application of vacuum.

Figure 2:
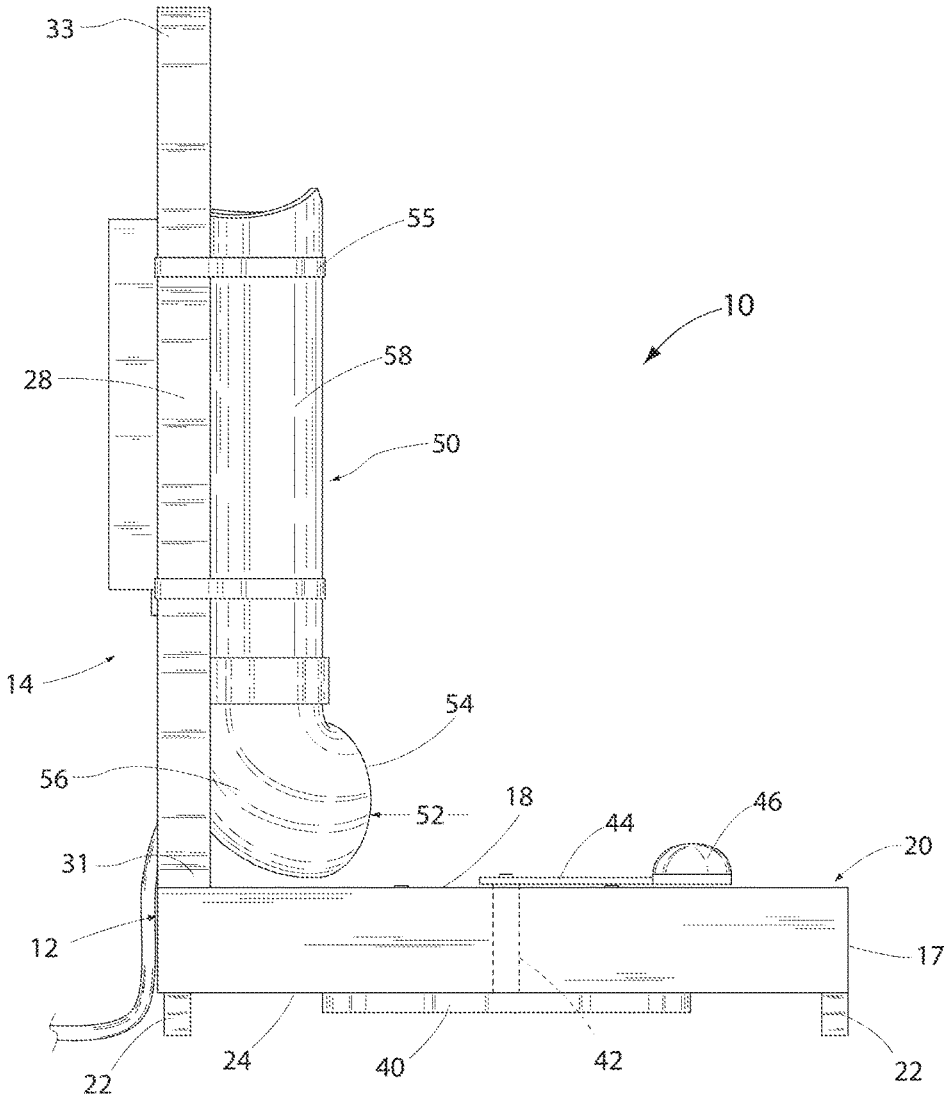
FIG. 2 is a side view of the agitator apparatus of FIG. 1.
Figure 3:
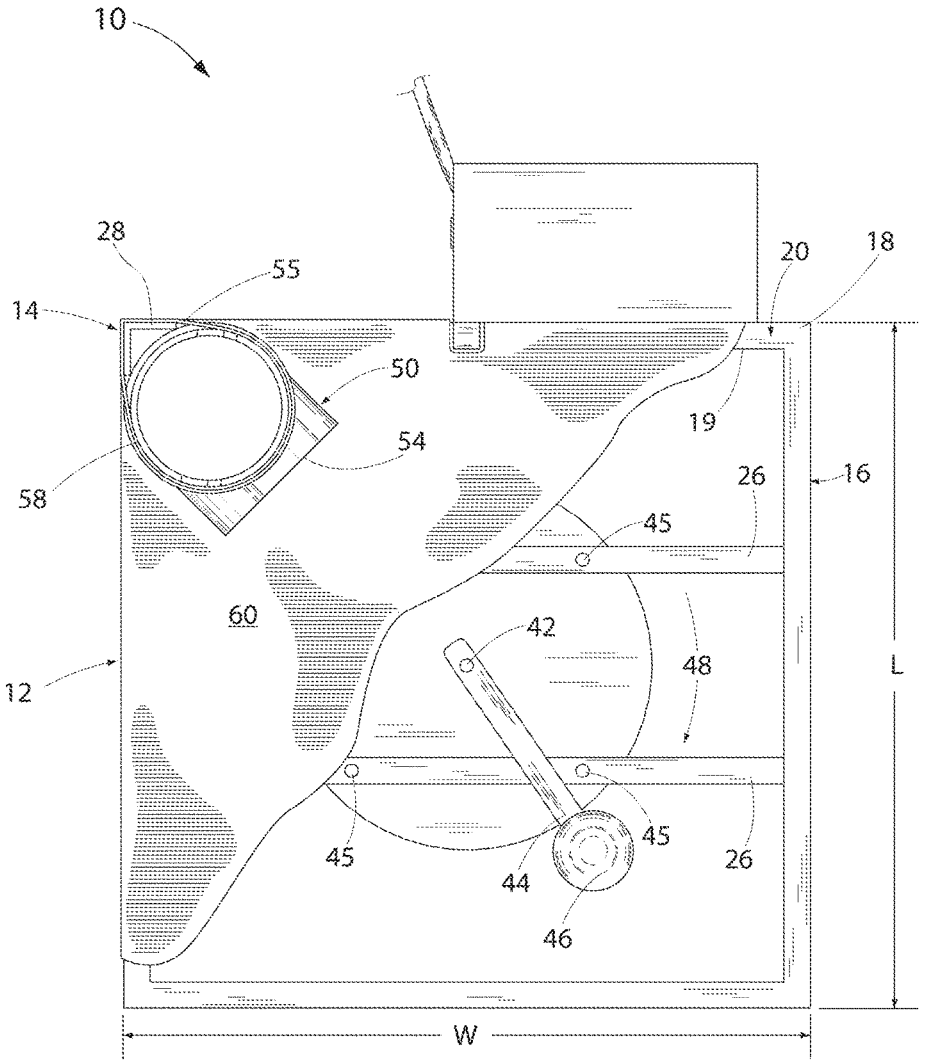
FIG. 3 depicts a top view of the agitator apparatus of FIG. 1.
Figure 4:
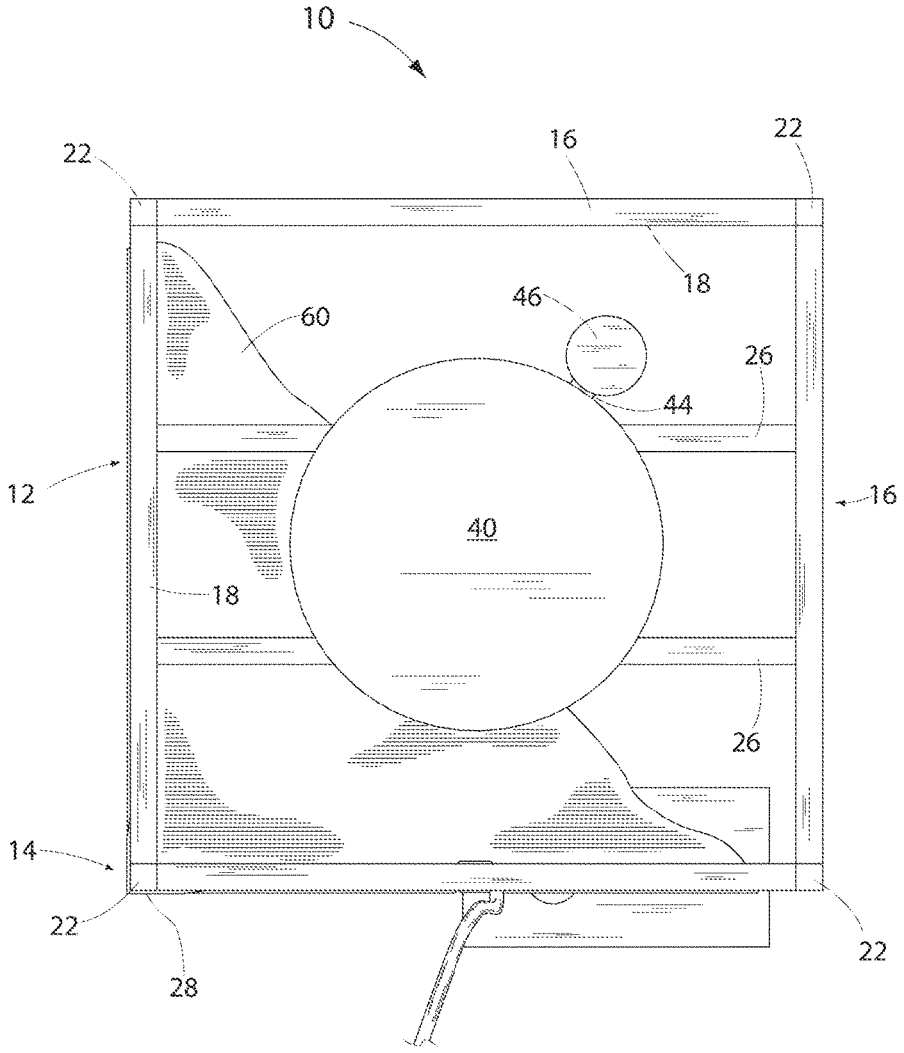
FIG. 4 is a bottom view of the agitator apparatus of FIG. 1.
Figure 5:
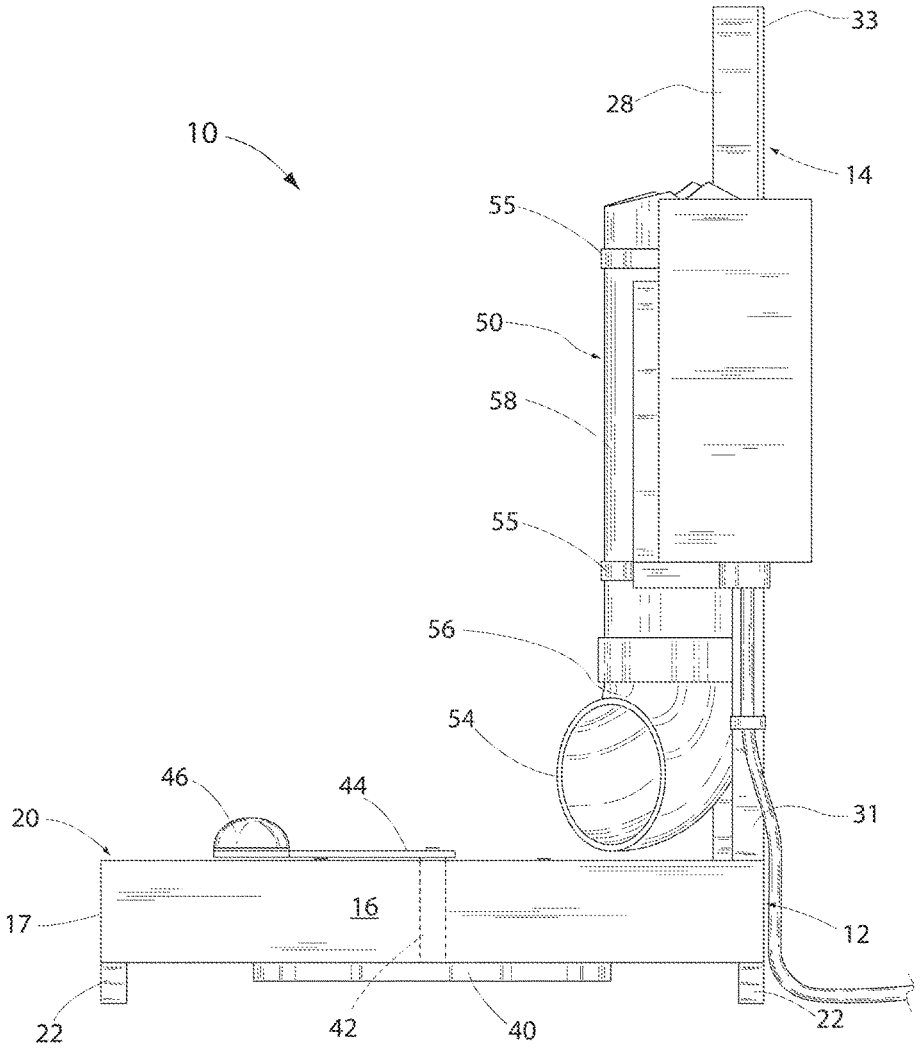
FIG. 5 is a front view of the agitator apparatus of FIG. 1.

Tubular member 50 has an inlet edge 54, an elbow portion 56 and a vertical portion 58, wherein the elbow portion connects the inlet edge to the vertical portion. In the embodiment of FIGS. 1-3, the inlet edge 54 of tubular member 50 is oriented vertically and an approximate right angle to the plane formed by the top surface 20 of the base portion 12. The tubular member 50 is attached to the vertical member 28 of the standing portion 14 so as to maintain the inlet edge 54 of the tubular member 50 immediately above the top surface 20 of base member 12. The attachment and positioning of the tubular member may conveniently be accomplished by the use of a plurality of band clamps 55, but other ways of securing the tubular member 50 in position may also be used to advantage. Care needs to be taken, however, not to use a fastening system that would interfere with or obstruct the free passage of balls through the tubular member 50.

For ease of explanation, the top surface 20 of base section 12 is illustrated as being fully or partially open. It should be apparent that, if the distance between the cross braces 26 and the inner edge 19 of the frame member 18 is greater than the diameter of the balls, then balls would enter that space. This would be undesirable as the ball in that space might interfere with the rotation of the armature 44 would, in any event, be outside the reach of the vacuum in tube 50. Accordingly, it is advantageous to space the cross braces away from inside edges 19 at a distance that is less than the diameter of the balls to prevent balls from falling into the interior space of base portion 12. Alternatively, the base portion may be covered by a sheath member, such as fabric covering 60 (shown partially sectioned in FIGS. 1 and 3) stretching across the base portion 12 from sidewall to sidewall to prevent balls from entering that space. It is to be understood that the sheath member, if used, could be a solid sheath, a perforated sheath, a mesh panel, a portion of fabric, or the like.

Figure 7:
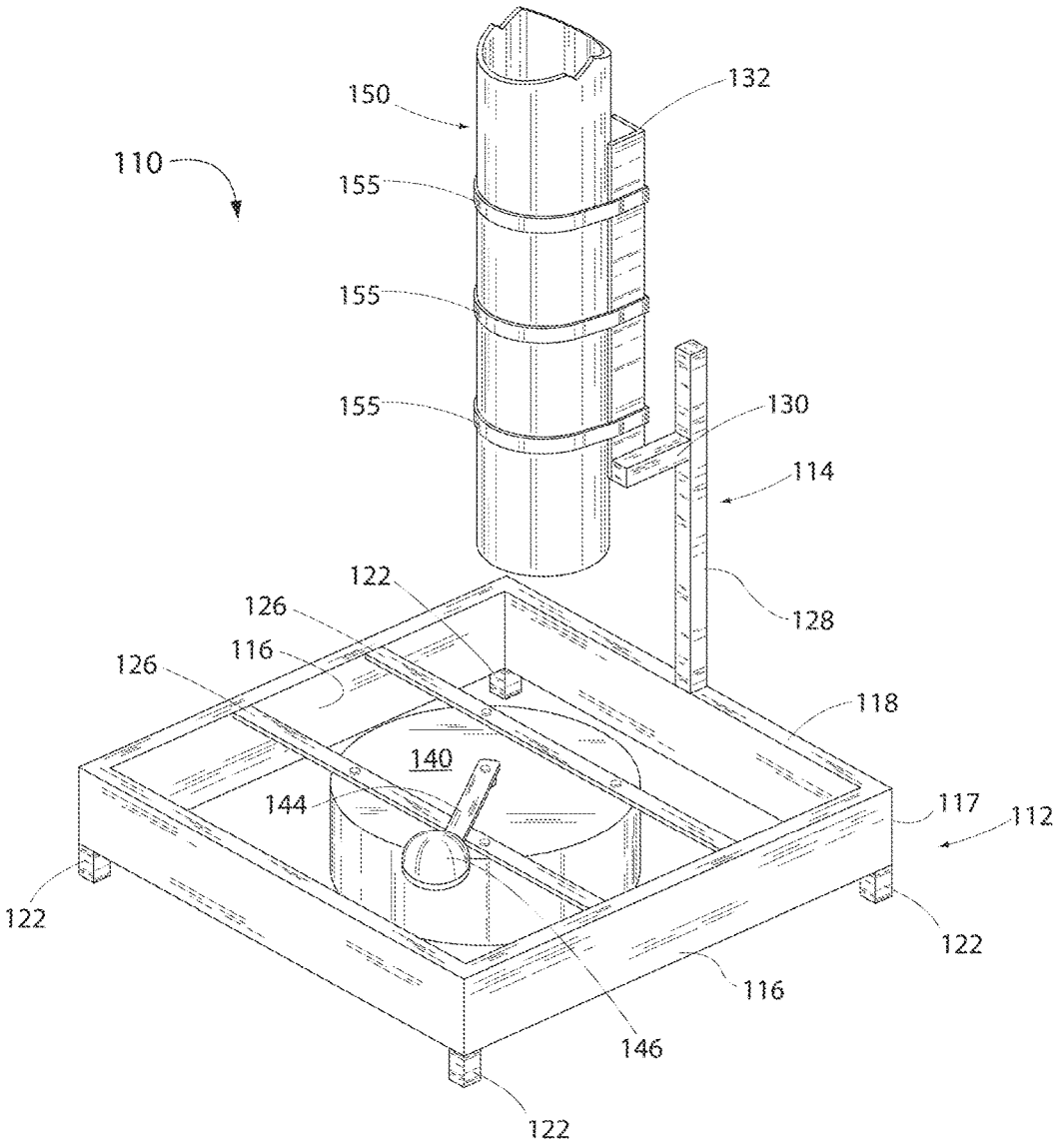
FIG. 7 is a perspective view of an alternate embodiment of an agitator apparatus.
Figure 8:
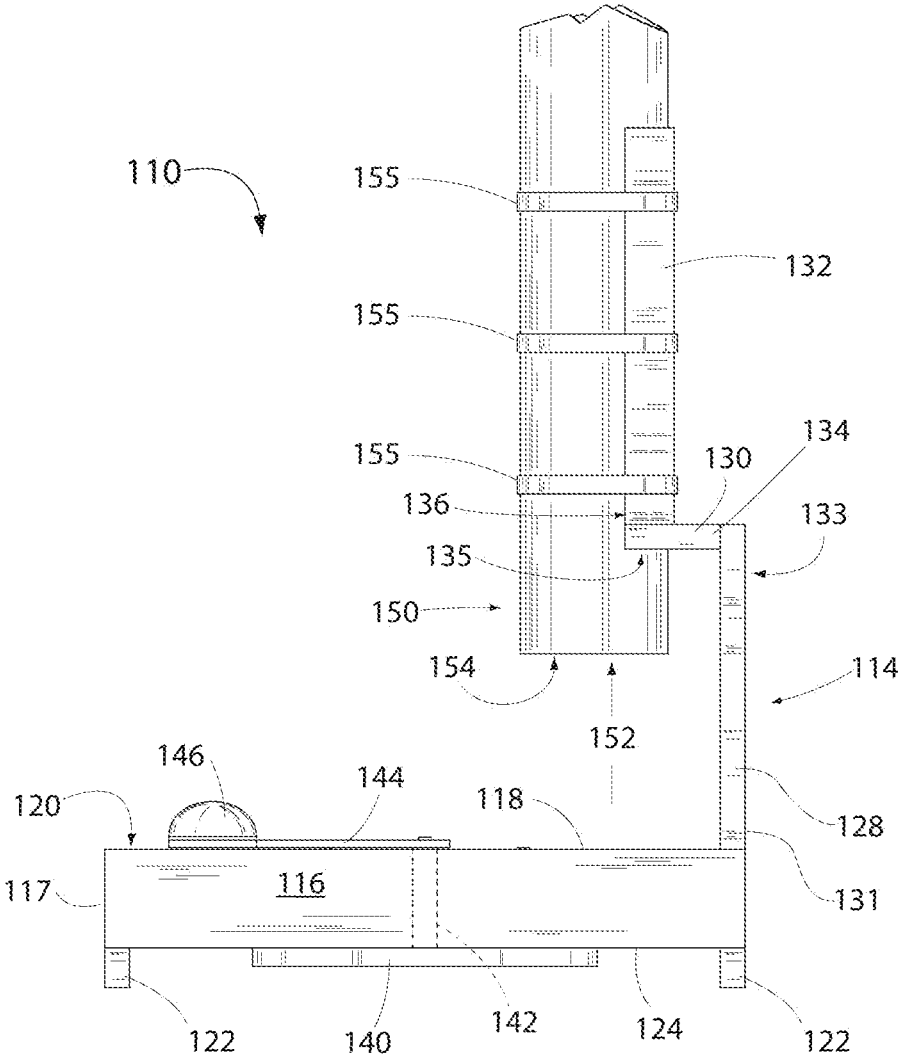
FIG. 8 is a side view of the agitator apparatus of FIG. 7.
Figure 9:
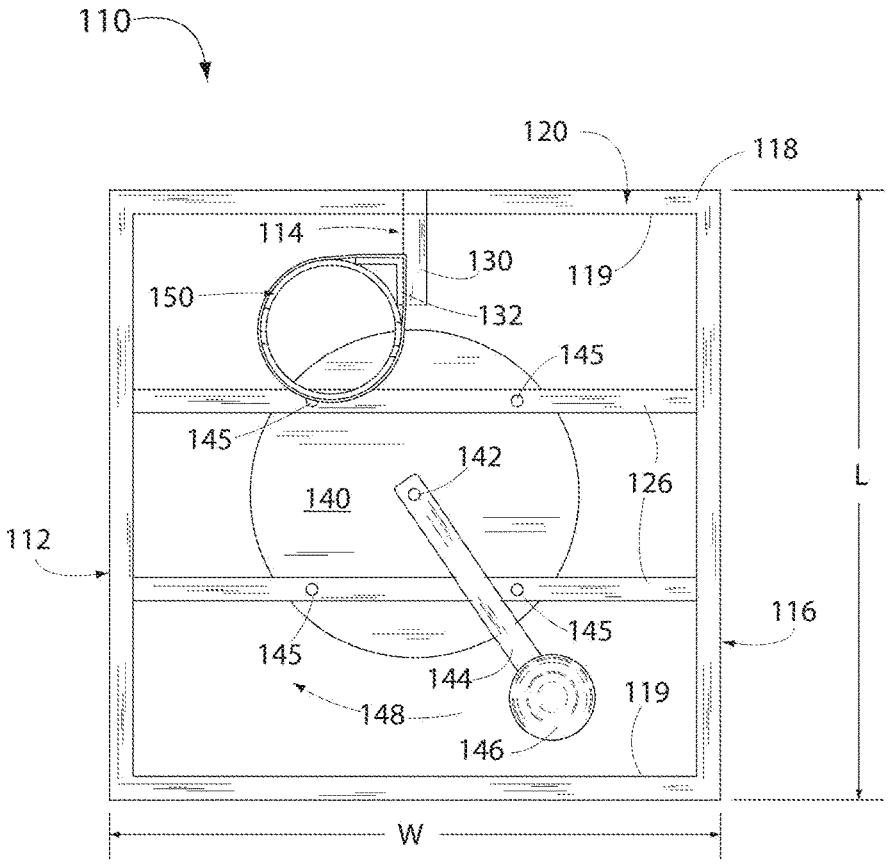
FIG. 9 is a top view of the agitator apparatus of FIG. 7.

With reference now being made to FIGS. 7-9, illustrated therein in an alternate embodiment of the agitator apparatus. The embodiment show in FIGS. 7-9 is similar to that of FIGS. 1-6. In particular, agitator apparatus 110 has a base portion 112 and a standing portion 114. Base portion 112, like the earlier embodiment, is a polygonal structure having a box-like configuration. While a preferred polygonal shape is a square or rectangle, other shapes such as triangle, trapezoid, parallelogram, circles, ovals, etc. may also be used to advantage. The base portion 112 has a frame member 118 defined by one or more sidewalls 116. The sidewalls 116 are arranged into the desired polygonal shape and connected together at their respective longitudinal ends in any known manner, forming the corners 117 of the polygon. The plane defined by the frame member 118 forms the top section 120 of the base portion 112.

Base portion 112 includes legs 122 that are conveniently disposed at the corners 117 of the polygon. Cross braces 126 traverse the open top section 120 of the base section 112 and may provide a convenient location for mounting the motor 140 and can provide additional rigidity and stability to the base portion 112. FIGS. 7-9 do not illustrate the sheath 60 shown in the prior embodiment of FIGS. 1-6.

One of the primary differences between the embodiment shown in FIGS. 1-6 and that show in FIGS. 7-9 is the configuration of the standing portion 114 of the agitator apparatus 10. As best seen in FIGS. 7 and 9, the standing portion 114 preferably has three components; a lower vertical member 128, a horizontal member 130 and an upper vertical member 132. Lower vertical member 128 has a first end 131 and a second end 133. The first end 131 is attached to the base portion 112, and preferably to the frame member 118 of base portion 112. The lower vertical member 128 is disposed generally perpendicular to the plane defined by the top section 120 of base portion 112. The second end 133 of lower vertical member 128 is attached to a first end 134 of horizontal member 130 such that horizontal member 130 is disposed generally parallel to the plane defined by the top section 120 of base member 112. The horizontal member 130 is oriented such that the second end 135 of horizontal member 130 is disposed above and preferably directly above, the plane of the top portion 120. Second end 135 of horizontal member 130 is attached to a first end 136 of upper vertical member 132 and is oriented so as to be generally perpendicular to the horizontal member 130. In this configuration, the upper vertical member 132 is oriented generally parallel to the lower vertical member 128 and spaced from the lower vertical member 128 in the horizontal direction.

The component pieces forming the standing portion 114, namely the lower vertical member 128, the horizontal member 130, and upper vertical member 132 may be constructed out of any suitable material, including wood, plastic, metal, fiberglass, or composites. Similarly, the method of attaching these component pieces to one another may be of any known method, including the use of adhesives, welding, or use of mechanical fasteners like nails, screws, bolts, rivets, etc. Those skilled in the art will also recognize the possibility that the standing portion 114 may comprise a single unitary structure formed by molding, casting, machining, three-dimensional printing, or other known techniques, if desired. To minimize damage to the play balls, any portions of the standing portion 114 that might present a sharp edge may be rounded. While the dimensions of the standing portion are not particularly significant, in one embodiment the lower member 128 is formed from one inch (2.54 cm) square tubing with a length of approximately eight inches (20.32 cm), the horizontal member 130 is formed from one inch (2.54 cm) square tubing with a length of approximately four inches (10.16 cm), and the upper vertical member 132 is formed from one inch (2.54 cm) square tubing with a length of approximately nine and a quarter inches (23.50 cm), respectively.

As in the previous embodiment, the agitator apparatus 110 further includes a motor 140, having a shaft 142 which rotates when the motor is in operation. An armature 144 is connected to shaft 142 so as to rotate with the shaft 142 when the motor 140 is in operation. A bumper 146 is attached to the armature 144 at an end of the armature 144 remote from the connection between the armature 144 and the shaft 142. It is advantageous that during operation the shaft 142, armature 144 and bumper 146 rotate in a clockwise direction, as indicated by arrow 148 in FIG. 9.

While not particularly significant, the length of the armature will be selected such that the armature may freely rotate without striking any portion of the agitator assembly 110, such as base portion 112 or standing portion 114, but defines a sufficient length such that armature 144 passes proximal to frame member 118 and sidewall 116 during operation (i.e. positions bumper 146 either contacting or immediately adjacent to the inside edge 119 of frame member 118). In some embodiments, the length of the armature may be approximately three and an eighth inches (7.93 cm) and formed from one half inch (1.27 cm) square or cylindrical tubing. Preferred bumper 146 is a domed member formed from nylon with a diameter of approximately one and a quarter inches (3.16 cm).

Motor 140 should be secured in place relative to the base portion 112 to prevent relative motion there between and, in a preferred embodiment, the motor 140 is secured to the cross braces 126 by a plurality of fasteners 145 (see FIG. 9).

Another primary difference between the embodiments is with respect to the tubular member. In the prior embodiment of FIGS. 1-6, the tubular member 50 had an angular configuration in which the elbow portion 56 provided a transition between the horizontally oriented inlet portion 54 and the vertical portion 58. In the embodiment of FIGS. 7-9, the tubular member 150 has a linear configuration and is oriented vertically and generally perpendicular to the plane of the base portion 112. Tubular member 150 has an internal diameter that will permit the passage of polymeric balls through the tubular member without hindrance. During operation, as will be explained more fully below, the polymeric balls are drawn into the tube in the direction of arrow 152 (see FIG. 8) by the application of vacuum. Tubular member 150 is attached to the upper vertical member 132 of the standing portion 114 so as to maintain the tubular member 150 above and spaced from the plane defined by the top surface 120 of the base portion 112. The distance between the top surface 120 and the inlet edge 154 of tubular member 150 will be determined in use by the diameter of the balls, the weight of the balls and the amount of vacuum applied. It is generally preferred that the distance between the top surface 120 (including any sheath used to cover the top surface 120) of the base portion 112 and the inlet edge 154 of the tubular member 150 be larger than the diameter of the balls to facilitate the ability to move balls freely underneath the inlet edge 154 of tubular member 150 where they can be acted upon by vacuum. For example, when the agitator apparatus 110 is used in connection with play balls having a diameter of at least two inches (5.08 cm) and preferably three inches (7.62 cm), the distance between the inlet edge 154 of tubular member 150 and the top surface 120 of the base portion 112 may be approximately three and a half inches (8.89 cm) and preferably may be defined as three and five eighths of an inch (9.21 cm). Stated differently, the distance between the top surface 120 of base portion 112 and the inlet edge 154 of tube 150 may be more than one, but less than two times the diameter of the play balls.

The tubular member 150 may be suspended above the top surface 120 of the base portion 112 by attaching the tubular member 150 to the upper vertical member 132 of the standing portion 114. In FIGS. 7-9, a plurality of band clamps 155 are used to secure the tubular member 150 in place, but other ways of securing the tubular member 150 in position may also be used to advantage. Care needs to be taken, however, not to use a fastening system that would interfere with the free passage of ball through the tubular member 150.

Figure 10:
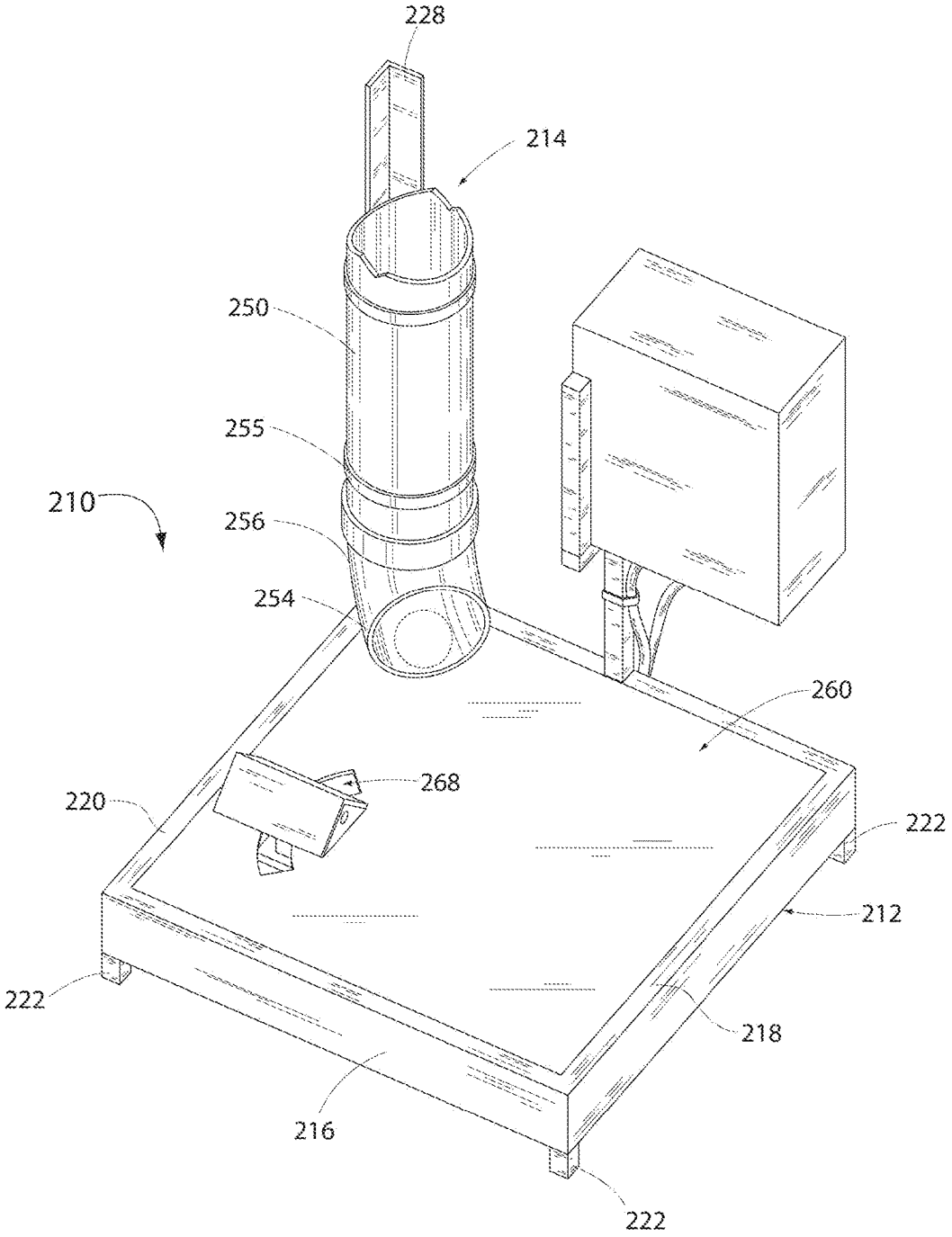
FIG. 10 is a perspective view of an alternate embodiment of an agitator apparatus.
Figure 11:
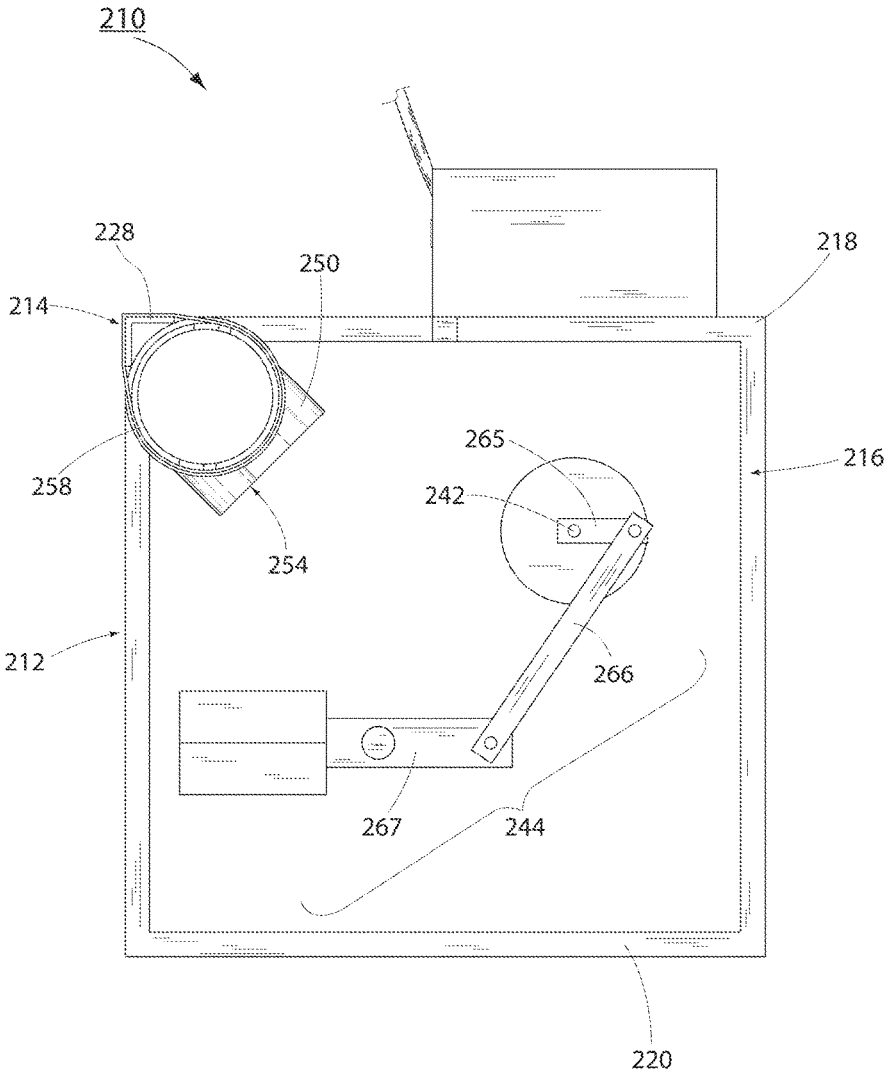
FIG. 11 is a top view of the agitator apparatus of FIG. 10.
Figure 12:
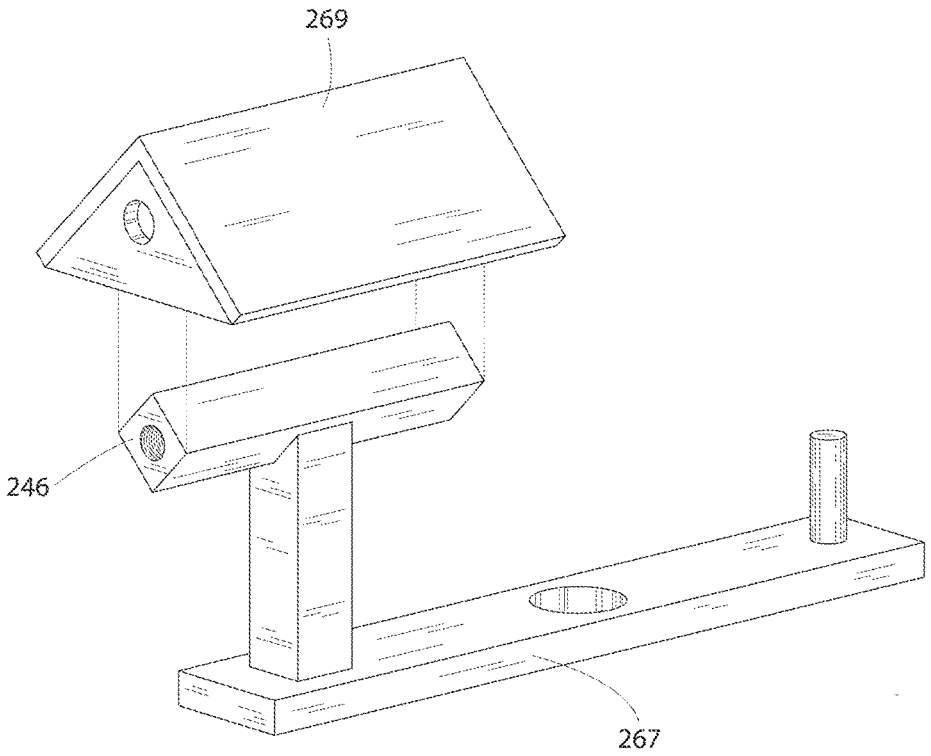
FIG. 12 is a perspective view of the bumper and pad of the agitator apparatus of FIG. 10.

An alternate embodiment of the agitator apparatus is illustrated in FIGS. 10-12. Similar to embodiments 10 and 110 described above, agitator apparatus 210 has a base portion 212 and a standing portion 214. Base portion 212, like the earlier embodiments, is a polygonal structure preferably defining a box-like configuration. While a preferred polygonal shape is a square or rectangle, other shapes such as triangle, trapezoid, parallelogram, circles, ovals, etc. may also be used to advantage. The base portion 212 has a frame member 218 defined by one or more sidewalls 216. The sidewalls 216 are arranged into the desired polygonal shape and connected together at their respective longitudinal ends in any known manner, forming the corners of the polygon. The plane defined by the frame member 218 forms the top section 220 of the base portion 212. Base portion 212 includes legs 222 that are conveniently disposed at the corners of the polygon but do not include cross braces to traverse the open top section of the base section 212 as described previously. Instead, one or more planar members 260 provides an overlay for mounting motor (not shown) therebeneath while providing additional rigidity and stability to the base portion 212. For example one planar member 260 may be positioned below linkage 244 in the nature of a floor while a second planar member 260 may be positioned above linkage 244 in the nature of a cover. The preferred embodiment of agitator device 210 does not call for a sheath as described in previous embodiments, but this should not be construed as a limitation on this particular embodiment of agitator.

The component pieces forming the base portion 212, namely the sidewalls 216, frame member 218, legs 222 and planar member 260 may be constructed out of any suitable material, including wood, plastic, metal, fiberglass, or composites. Similarly, the method of attaching these component pieces to one another may be of any known method, including the use of adhesives, welding, or use of mechanical fasteners like nails, screws, bolts, rivets, etc. Those skilled in the art will also recognize the possibility that the base portion 212 may comprise a single unitary structure formed by molding, casting, machining, pressing, three-dimensional printing, or other known techniques, if desired. In order to minimize damage to the play balls, portions of the base member that may present a sharp edge, such as the corners, may be rounded.

In the embodiment of FIGS. 10-12, the standing portion 214 of the agitator apparatus 210 comprises a vertical member 228 that may be disposed either at one of the corners of the base portion 212 like the first embodiment or in the middle of base portion 212 like the second embodiment. Vertical member 228 has a first end and a second end. The first end is attached to the base portion 212, and preferably to the frame member 218 of base portion 212. The vertical member 228 is disposed generally perpendicular to the plane defined by the top of base portion 212. The dimensions of vertical member 228 are similar to those described previously.

The agitator apparatus 210 further includes a motor (not shown in this embodiment), which may advantageously be an electric motor operating on either AC or DC current. The motor includes a vertical shaft 242 which rotates when the motor is in operation. A linkage 244 is connected to shaft 242 so as to rotate with the shaft 242 when the motor is in operation. A bumper 246 (FIG. 12) is attached to the linkage 244 at an end of the linkage 244 distal or remote from the connection between the linkage 244 and the shaft 242. Accordingly, it is understood that the bumper 246 and linkage 244 both rotate with the shaft 242 during operation of the motor. It is advantageous that the shaft 242 be fixed relative to the center of the motor, but not necessarily relative to planar member 260, such that the movement of bumper 246 is generally concentric as opposed to eccentric. It is also advantageous that during operation, the shaft 242, linkage 244 and bumper 246 rotate in an incomplete circular manner, which is to say that the travel of bumper 246 is defined by an arch instead of a circle.

While not particularly significant, the length of the linkage members will be selected such that the linkage 244 may freely rotate without striking any portion of the agitator assembly 10, such as base portion 212 or standing portion 214, but defines a sufficient length such that linkage 244 passes proximal to intake edge 254 of tubular member 250. In a preferred embodiment, a first linkage member 265 defines a length of two and three quarter inches (6.99 cm), a width of one inch (2.54 cm) and a thickness of a quarter inch (0.64 cm), a second linkage member 266 defines a length of five and three eighths of an inch (13.65 cm), a width of one inch (2.54 cm) and a thickness of a quarter inch (0.64 cm), and a third linkage 267 defines a length of six inches (15.24 cm), a width of one inch (2.54 cm), and a thickness of a quarter inch (0.64 cm). Preferred bumper 246 is a substantially square member with sides half an inch (1.27 cm) in length, and as described below preferably further includes a bumper pad. Bumper 246 is constructed out of any suitable material, including wood, plastic, metal, fiberglass, or composites.

Tubular member 250 has an inlet edge 254, an elbow portion 256 and a vertical portion 258, wherein the elbow portion connects the inlet edge to the vertical portion. In the embodiment of FIGS. 10-12, the inlet edge 254 of tubular member 250 is oriented vertically and an approximate right angle to the plane formed by the top surface 220 of the base portion 212. The tubular member 250 is attached to the vertical member 228 of the standing portion 214 so as to maintain the inlet edge 254 of the tubular member 250 immediately above the top surface 220 of base member 212. The attachment and positioning of the tubular member may conveniently be accomplished by the use of a plurality of band clamps 255, but other ways of securing the tubular member 250 in position may also be used to advantage. Care needs to be taken, however, not to use a fastening system that would interfere with or obstruct the free passage of balls through the tubular member 250.

Unlike the previous embodiments, agitator apparatus 210 includes planar member 260 that defines channel 268 in the surface therein. In the preferred embodiment, channel 268 defines an arcuate path for bumper 246 attached to third linkage 267 to travel therein. As the motor rotates, linkage members 265, 266, and 267 pivot relative to one another via joints defined by cooperative apertures and respective fasteners therein. This rotating motion produces the arching motion of bumper 246 that in turn results in the striking of balls (not shown) in the direction of tubular member 250. In the preferred embodiment, bumper pad 269 is affixed to the outer or top surface of bumper 246 to facilitate the predictable striking action described above. In one embodiment, bumper pad 269 defines a generally angular or "V" cross-sectional shape, with a length of three and three quarter inches (9.53 cm), a width of one and a half inches (3.81 cm) and a thickness of one eighth of an inch (0.32 cm). Bumper pad 269 may be fainted from any suitable material that can withstand repeated striking of plastic balls, including but not limited to wood, metal, and plastic embodiments, and bumper pad 269 may be formed integrally from a single material, or alternatively be formed from a structural first material and a second, more resilient material intended to launch the balls in the direction of tubular member 250 (the first material different from the second material). Bumper pad 269 may be attached to bumper 246 by any method appropriate for the materials utilized, and may include adhesive, welding, mechanical fasteners, and the like.

In use, the agitator device 10/110/210 will be placed into a pen, pool or other contained space containing lightweight polymeric balls. The base portion 12/112/212 will be at least partially submerged in the collection of balls. The motor 40/140 will then be powered up and the shaft 42/142/242, armature 44/144 or linkage 244, and bumper 46/146/246 will begin to rotate in a clockwise direction. Actuation of the motor 40/140 may be accomplished in any known manner, such as by operation of a switch. While not illustrated in the Figures, the agitator device may be equipped with a switch to operate the motor 40/140, or the motor 40/140 may be operated from a remote location via a control transponder. In other embodiments, the motor may be battery powered and have a self-contained switch or timer switch. As the armature 44/144 or linkage 244 rotates, the bumper 46/146/246 will make contact with balls (either directly or indirectly via movement of a flexible sheath) and urge the balls to a location proximate the inlet edge 54/154/254 of the tubular member 50/150/250.

A negative pressure differential is created within the tubular member 50/150/250 by applying vacuum, which may be a feature of a ball washer device as taught in U.S. Pat. No. 5,647,089 and U.S. Pat. No. 6,389,639, the entire disclosures of which are incorporated herein by reference. The negative pressure differential results in the ball being drawn into the tubular member 50/150/250 and transported via suitable conduit to a ball washer before being returned to the confined ball space. One skilled in the art will be able to determine the amount of vacuum needed to transport the balls being used for the particular operation.

It is preferable to control the speed of rotation of the armature, linkage, and bumper whereby the balls contacted by the bumper are gently agitated to maintain the balls in motion within the area defined by the base portion. In this manner, as one ball is drawn into the tubular member by vacuum, another will be agitated into position proximate the inlet edge of the tubular member where it can be acted upon by vacuum. If the armature or linkage and bumper are operating at a high rate of speed, the balls may be struck with such force as to cause the balls to be flung about the ball pool or other confined space. Or they may be moving so quickly that the vacuum cannot operate to draw the balls into the tubular member. Neither of these situations is desirable. One skilled in the art will be able to determine the appropriate rotational speed based on the size and weight or the balls, the amount of vacuum being applied and other factors presented for that particular operation.

The illustrations and examples provided herein are for explanatory purposes and are not intended to limit the scope of the appended claims.

I claim:

1. An apparatus comprising:

a base portion;

a standing portion attached to the base portion, wherein the standing portion is oriented in a vertical direction and generally perpendicular to a horizontal plane defined by the base portion;

a motor having a rotatable shaft, a linkage connected to the rotatable shaft, and a bumper connected to the linkage at a location removed from the rotatable shaft; and a tubular member connected to the standing portion and oriented generally perpendicular to and spaced from the horizontal plane formed by the base portion, said tubular member having an internal diameter that is generally free of obstructions to facilitate passage of spherical objects through said tubular member.

2. The apparatus of claim 1, wherein the base portion comprises a plurality of sidewalls oriented to form a polygonal shape; a top frame; and a plurality of legs, each leg disposed at a corner of the polygonal shape.

3. The apparatus of claim 1, wherein the standing portion comprises a lower vertical member attached to the base portion, said lower vertical member being oriented generally perpendicular to the horizontal plane formed by the base portion; an upper vertical member being oriented generally perpendicular to the horizontal plane formed by the base portion, and spaced from the lower vertical member in both the vertical and horizontal directions; and a horizontal member connecting the lower vertical member with the upper vertical member.

4. The apparatus of claim 3, wherein the tubular member comprises a hollow, linear tube and is attached to the upper vertical member and oriented in a vertical direction.

5. The apparatus of claim 1, wherein the base portion further comprises a planar member defining a channel sized and shaped to facilitate the travel of the bumper therein, said planar member traversing the base portion to provide rigidity.

6. The apparatus of claim 1, wherein the tubular member comprises a vertical portion attached to the standing member, a horizontal inlet edge and an elbow portion connecting the inlet edge with the vertical portion to form a continuous conduit.

7. The apparatus of claim 1, wherein the interior of the tubular member defines an area of negative pressure.

8. The apparatus of claim 7, operatively connected to a ball washer device, said ball washer device providing said negative pressure within the tubular member, the ball washer device being connected to the tubular member to permit transport of balls from within the tubular member to the ball washer device.

9. The apparatus of claim 1, wherein the linkage rotates in a clockwise direction.

10. The apparatus of claim 1 further comprising a bumper pad affixed to the bumper.

11. A method comprising the steps of:

placing an agitator apparatus in a confined space containing a plurality of polymeric balls;

agitating the balls with the agitator apparatus to create substantially continuously motion of the balls within a reach of the agitator apparatus;

subjecting one or more balls to an area of negative pressure sufficient to transport the one or more balls by vacuum to a ball washing device;

wherein the agitator apparatus comprises a base portion and a standing portion attached to the base portion, wherein the standing portion is oriented in a vertical direction and generally perpendicular to a horizontal plane defined by the base portion; a motor having a rotatable shaft, linkage connected to the rotatable shaft, and a bumper connected to the linkage at a location removed from the rotatable shaft; and a tubular member connected to the standing portion, said tubular member having an internal diameter generally free of obstructions to facilitate passage of the one or more balls through said tubular member.

12. The method of claim 11, wherein the base portion of the agitator apparatus comprises a plurality of sidewalls oriented to form a polygonal shape; a top frame; and a plurality of legs, each leg disposed at a corner of the polygonal shape.

13. The method of claim 11, wherein the standing portion of the agitator apparatus comprises a lower vertical member attached to the base portion, said lower vertical member being oriented generally perpendicular to the horizontal plane formed by the base portion; an upper vertical member being oriented generally perpendicular to the horizontal plane formed by the base portion, and spaced from the lower vertical member in both the vertical and horizontal directions; and a horizontal member connecting the lower vertical member with the upper vertical member.

14. The method of claim 13, wherein the tubular member of the agitator apparatus is attached to the upper vertical member.

15. The method of claim 11, wherein the base portion of the agitator apparatus further comprises a planar member defining a channel sized and shaped to facilitate the travel of the bumper therein, said planar member traversing the base portion to provide rigidity.

16. The method of claim 11, wherein the tubular member comprises a vertical portion attached to the standing member, a horizontal inlet edge and an elbow portion connecting the inlet edge with the vertical portion to form a continuous conduit.

17. The apparatus of claim 11, wherein the interior of the tubular member defines the area of negative pressure.

18. The method of claim 11, wherein the linkage rotates in a clockwise direction.

19. The method of claim 18, wherein the bumper carries a bumper pad.

20. The method of claim 11, further comprising the step of returning the balls in close proximity to the confined space.

* * * * *